US005365152A

United States Patent [19]

Ozawa et al.

[11] Patent Number: 5,365,152

[45] Date of Patent: Nov. 15, 1994

[54] APPARATUS FOR CONTROLLING THE POWER TO A DISCHARGE-LAMP

[75] Inventors: Masataka Ozawa, Takarazuka; Takayuki Kamitani, Osaka; Kazutaka Koyama, Nishinomiya; Shigeru Horii, Takatsuki; Koji Miyazaki, Yawata; Nobuhisa Yoshikawa, Sakai; Takeshi Saito, Amagasaki; Kazuhiko Ito, Hirakata; Masayoshi Gyoten, Takatsuki; Atsuo Waki, Osaka, all of Japan

[73] Assignee: Matsushita Electric Industrial Co. Ltd., Kadoma, Japan

[21] Appl. No.: 931,730

[22] Filed: Aug. 18, 1992

[30] Foreign Application Priority Data

Sep. 9, 1991 [JP] Japan ..... 3-227753
Nov. 18, 1991 [JP] Japan ..... 3-300932

[51] Int. Cl.[5] ..... G05F 1/00

[52] U.S. Cl. ..... 315/291; 315/307; 315/308; 315/224; 315/127

[58] Field of Search ..... 315/291, 307, 308, 224, 315/127

[56] References Cited

U.S. PATENT DOCUMENTS

| | | | |
|---|---|---|---|
| 4,904,907 | 2/1990 | Allison et al. | 315/307 |
| 4,906,901 | 3/1990 | Carroll | 315/297 |
| 5,142,203 | 8/1992 | Oda et al. | 315/308 |
| 5,204,587 | 4/1993 | Mortimer et al. | 315/308 |

FOREIGN PATENT DOCUMENTS

| | | |
|---|---|---|
| 3211240 | 10/1982 | Germany . |
| 3905715 | 2/1988 | Germany . |
| 210697 | 1/1990 | Japan . |
| 2136342 | 5/1990 | Japan . |
| 2136343 | 5/1990 | Japan . |
| 2215090 | 8/1990 | Japan . |
| 38299 | 1/1991 | Japan . |
| 456247 | 11/1991 | United Kingdom . |

*Primary Examiner*—Benny Lee
*Assistant Examiner*—Reginald A. Ratliff
*Attorney, Agent, or Firm*—Cushman, Darby & Cushman

[57] ABSTRACT

In a discharge-lamp lighting apparatus for lighting a discharge lamp such as a metal halide lamp, there is provided a lighting control circuit which controls its output in a starting time of the discharge lamp in response to at least a length of the last off-time and an on-time after the start of discharging; and a power supplied to the discharge lamp is controlled in accordance with this output of the lighting control circuit.

5 Claims, 10 Drawing Sheets

APPARATUS FOR CONTROLLING THE POWER TO A DISCHARGE-LAMP

FIELD OF THE INVENTION AND RELATED ART STATEMENT

1. Field of the Invention

The present invention relates to a discharge-lamp lighting apparatus which executes lighting-control for a discharge lamp such as a metal halide lamp.

2. Description of the Related Art in general, when a high-voltage discharge lamp such as a metal halide lamp Is cold-started, light-output (amount of light) increases very slowly on condition that a constant electric power is given to the discharge lamp. This is because the light-output increases as time lapses in response to a change of a vapor pressure of a light-emitting metal. Therefore, in the prior art apparatus, to accelerate the increase of the light-output, a relatively large current has to be supplied to the discharge lamp within a certain time just after it having started, and the current is reduced with a lapse of time to a predetermined level of lamp current by which the discharge lamp keeps a rated lighting state. A control apparatus having the above-mentioned control procedure is disclosed, for example, in Japanese unexamined patent application TOKKAI Hei 2-10697. This control apparatus is suitable for lighting the discharge lamp which is in the cold state.

However, the control apparatus is not suitable for a hot start such as exemplified in the following case:

(1) to light the lamp again after a long-time on and a subsequent short-time off;

(2) to light the lamp again after a long-time on and a subsequent relatively-long-time off; or (3) to light the lamp again after a short-time on and a subsequent short-time off.

When the discharge lamp is lit (re-started) as mentioned In the case (1), (2) or (3), the light-output exceeds a predetermined level because the discharge lamp is already warm. As a result, the temperature-rise of the discharge lamp increases, and a lifetime of the discharge lamp is thereby shortened.

OBJECT AND SUMMARY OF THE INVENTION

An object of the present invention is to offer a discharge-lamp lighting apparatus which can quickly complete a starting action of a discharge lamp and which controls the light-output of the discharge lamp so as not to exceed the predetermined output at any condition of the discharge lamp.

In order to achieve the above-mentioned object, the discharge-lamp lighting apparatus of the present invention comprises:

a discharge lamp;

lamp current supply means for supplying the discharge lamp with a current; and lighting control means for controlling an output of the lamp current supply means In response to an off-time and an on-time of the discharge lamp, the lighting control means increasing its initial output in response to increase of the off-time and decreasing its output to a rated output as time lapses after start-up of the discharge lamp.

According to this construction, the light-output of the discharge lamp is quickly increased up to the rated output from any condition of the discharge lamp and is properly controlled so as not to exceed the predetermined output.

Further, another discharge-lamp lighting apparatus of the present invention comprises:

a discharge lamp;

lamp current supply means for supplying the discharge lamp with a current;

lamp voltage detection means for detecting a lamp voltage applied to the discharge lamp;

lamp current detection means for detecting a lamp current flowing in the discharge lamp;

power control means which receives outputs of the lamp voltage detection means and the lamp current detection means to control a lamp power of the discharge lamp; and a lighting control circuit which receives an output of the lamp voltage detection means within a starting-time of the discharge lamp and issues an output signal for controlling the lamp power to the power control means, the lighting control circuit changing a level of the output signal in inverse relation to the lamp voltage and issuing a constant output signal for lighting the discharge lamp with a rated power after the starting time.

According to this construction, the lamp power of the discharge lamp is surely and properly controlled in response to the lamp voltage, and the discharge lamp is lit to a rated level in a steady lighting state.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Hereafter, preferred embodiments of the present invention are described with reference to the accompanying drawings.

[First Embodiment]

Figure 1:
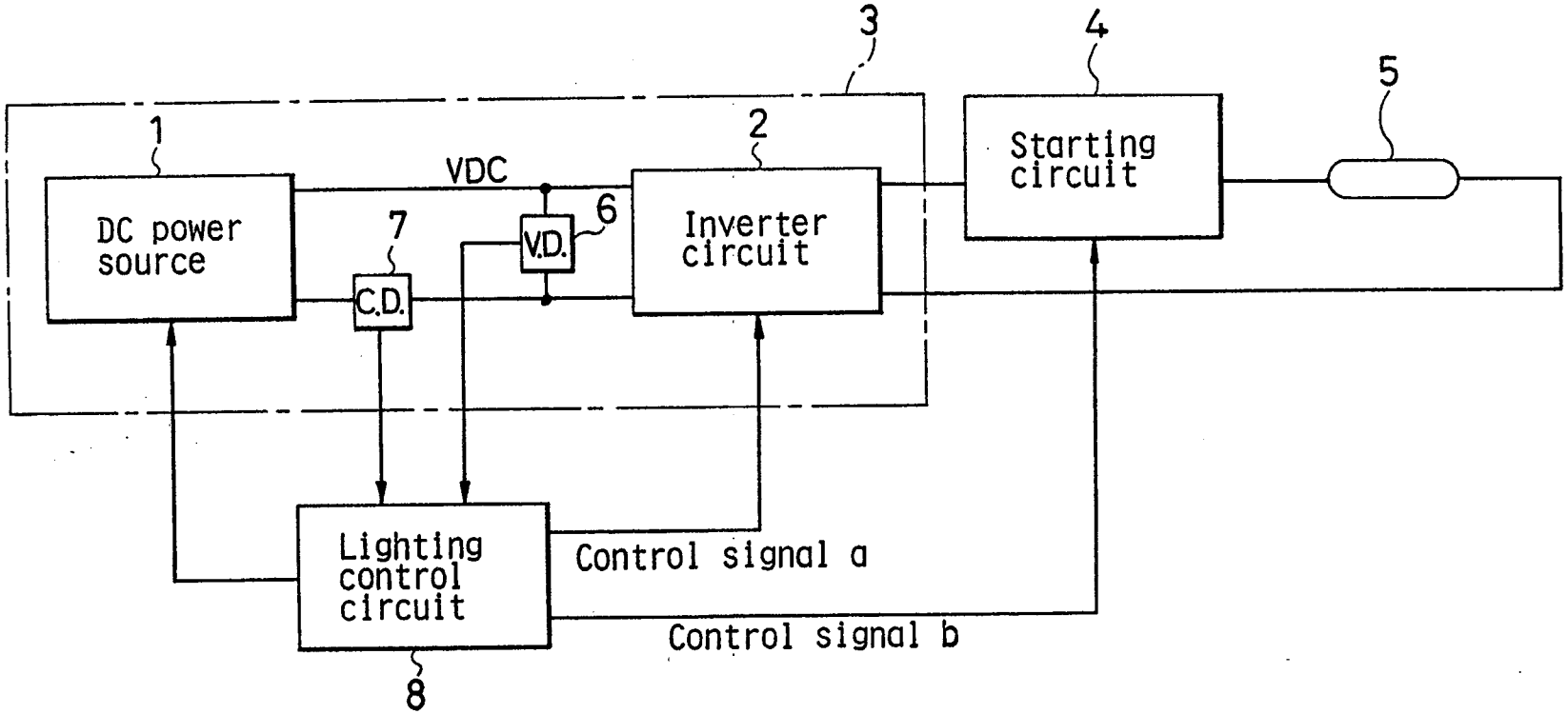
FIG. 1 is a block diagram showing a basic construction of a discharge-lamp lighting apparatus in a first embodiment of the present invention.

FIG. 1 is a block diagram showing a basic construction of a discharge-lamp lighting apparatus of a first embodiment. In FIG. 1, an inverter circuit 2, which is driven by a DC power source 1, inverts a DC voltage with a predetermined frequency, thereby issuing a rectangular-wave voltage. The DC power source 1 and the inverter circuit 2 constitute lamp-current supply means 3. The inverter circuit 2 has a load circuit consisting of a discharge lamp 5 such as a metal halide lamp and a starting circuit 4 which contains an inductance component. A DC voltage detection circuit 6 is connected to an output end of the DC power source 1, and a DC current detection circuit 7 is inserted between the DC power source 1 and the inverter circuit 2 to detect current flowing to the inverter circuit 2 from the DC power source 1. The DC voltage detection circuit 6 detects DC voltage, thereby to detect starting of the discharge lamp 5 and control a state after the start and a rated lighting state. Output signals issued from this DC voltage detection circuit 6 and DC current detection circuit 7 are input to a lighting control circuit 8. This lighting control circuit 8 forms lighting control means together with the DC voltage detection circuit 6 and the DC current detection circuit 7. An oscillating frequency or a duty ratio of the DC power source 1 is changed by the lighting control circuit 8 in accordance with the output signals input to the lighting control circuit 8. Lighting operation of the discharge lamp 5 is thus controlled.

Next, the basic operation of the above-mentioned first embodiment is described. When the DC power source 1 is turned on, the inverter circuit 2 begins to oscillate with a high frequency (e.g., 5 kHz), and the DC voltage detection circuit 6 detects an output voltage of the DC power source 1. When this output voltage reaches a predetermined voltage required for starting, the lighting control circuit 8 turns the starting circuit 4 on in response to an output of the DC voltage detection circuit 6, thereby applying a starting voltage to the discharge lamp 5. The discharge lamp 5 thereby starts to discharge. As a result of current-flowing through the discharge lamp 5, a voltage applied between both ends of the discharge lamp 5 lowers, and the output voltage of the DC power source 1 also lowers. By detecting this voltage drop by way of the DC voltage detection circuit 6, the lighting control circuit 8 knows that the discharge lamp 5 has just started discharging, and turns the starting circuit 4 off. Once the discharge lamp 5 starts discharging, the lighting control circuit 8 controls the output of the DC power source 1 in response to an off-time before the start and an on-time after the start. That is, the longer the off-time is, the larger the output just after the start becomes. Once started, the output is gradually reduced as the on-time lapses until the discharge lamp 5 is lit to the rated power. When the output comes close to the rated power, the oscillating frequency of the inverter circuit 2 is lowered to a low frequency (e.g., 400 Hz), thereby making a stable on-state without any trouble of acoustic resonance.

Figure 2:
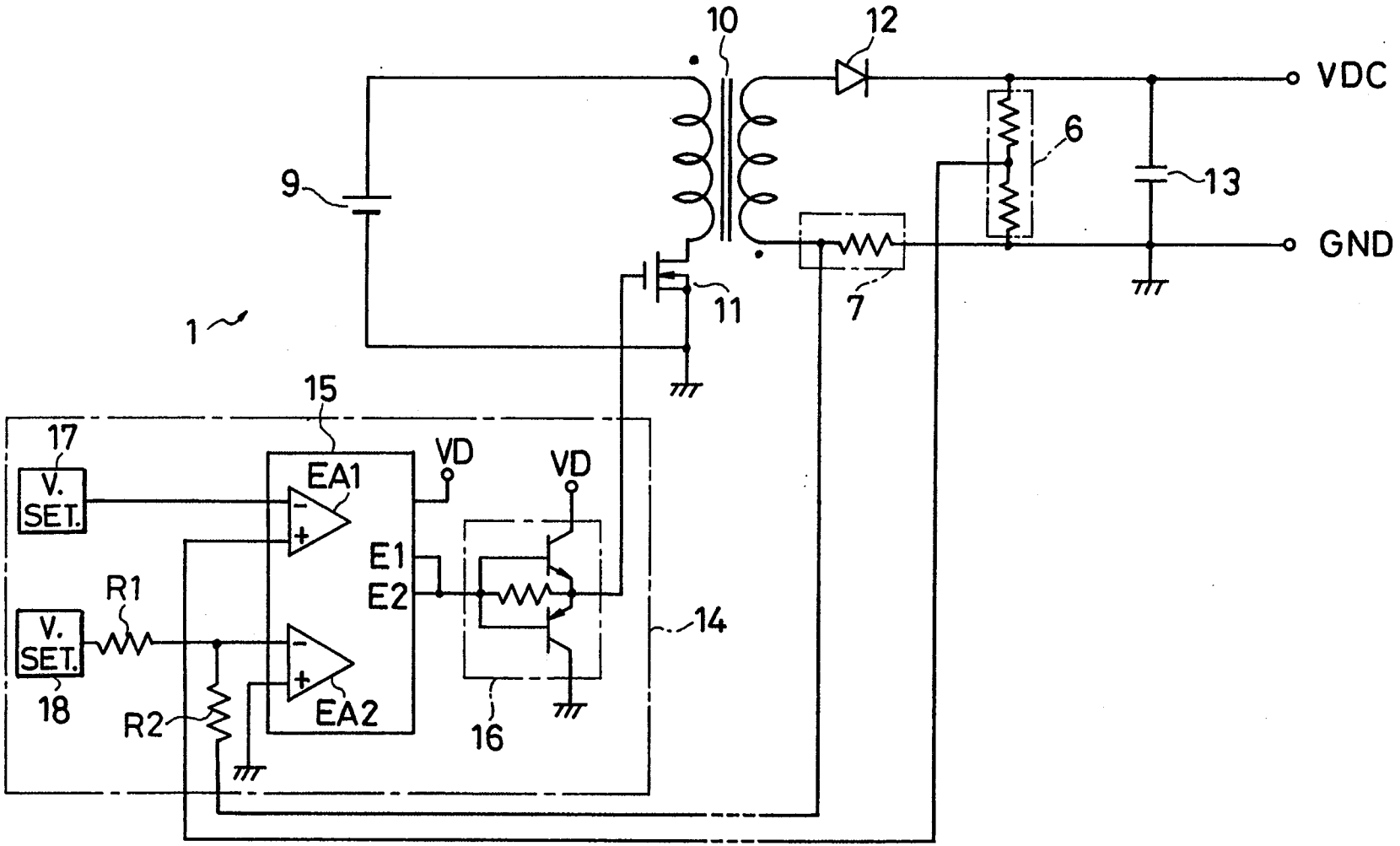
FIG. 2 is a circuit diagram showing a main part of a DC power source 1 shown in FIG. 1.

FIG. 2 is a circuit diagram showing a main part of the DC power source 1 shown in FIG. 1. In the strict sense of the word, the DC power source 1 corresponds to circuits excluding the DC voltage detection circuit 6 and the DC current detection circuit 7. In FIG. 2, a primary winding of a flyback transformer 10 is connected to a battery 9, and a transistor 11 Is connected in series to the flyback transformer 10. A diode 12 and a capacitor 13, which are connected in series to each other, are connected to a secondary winding of the flyback transformer 10. These battery 9, flyback transformer 10, transistor 11, diode 12 and capacitor 13 constitute a flyback type DC/DC converter. At both ends of the capacitor 13, there arises an output voltage of the DC power source 1. The DC voltage detection circuit 6 is provided in parallel with the capacitor 13, and the DC current detection circuit 7 is inserted in a secondary circuit connected to the secondary winding of the flyback transformer 10. These detection circuits 6 and 7 correspond to the detection circuit 6 and 7 in FIG. 1, respectively. A control circuit 14 controls an output of the DC power source 1. The control circuit 14 includes a switching-regulator control IC 15, a buffer circuit 16 and voltage setting circuits 17 and 18. An output voltage of the DC voltage detection circuit 6 is inputted to the non-inverted input terminal of an error amplifier EA1 mounted in the IC 15. An output voltage of the DC current detection circuit 7 is input to the inverted input terminal of an error amplifier EA2 mounted in the IC 15 by way of a resistor R2. An output voltage of the voltage setting circuit 17 is input to the inverted terminal of the error amplifier EA1, and an output voltage of the voltage setting circuit 18 is input to the inverted input terminal of the error amplifier EA2 by way of a resistor R1. Oscillating outputs E1 and E2 are input to the gate of the transistor 11 by way of the buffer circuit 16.

When an oscillating signal is supplied to the gate of the transistor 11, the transistor 11 executes a high speed switching action. Therefore, current flows through the flyback transformer 10, thereby generating a voltage at the secondary winding of the flyback transformer 10. This voltage is rectified by the diode 12 and smoothed by the capacitor 13. Thus, a DC output voltage VDC arises at an output end of the DC power source 1. At that time, the output voltage and an output current are detected by the DC voltage detection circuit 6 and the DC current detection circuit 7, respectively. The actual voltage signal and current signal detected by the DC voltage detection circuit 6 and the DC current detection circuit 7 are compared with set voltage signals supplied from the voltage setting circuits 17 and 18, respectively. Duty ratios of the oscillating outputs E1 and E2 are controlled by the switching-regulator control IC 15 in response to output levels of the error amplifiers EA1 and EA2 so that the actual voltage signal and the actual current signal may not exceed levels of the set voltage signals. As a result, the output of the DC power source 1 (FIG. 1) is stable at a condition given by the set voltage or the set current. The alternative of the set voltage or the set current depends on which is nearer to it.

Figure 3:
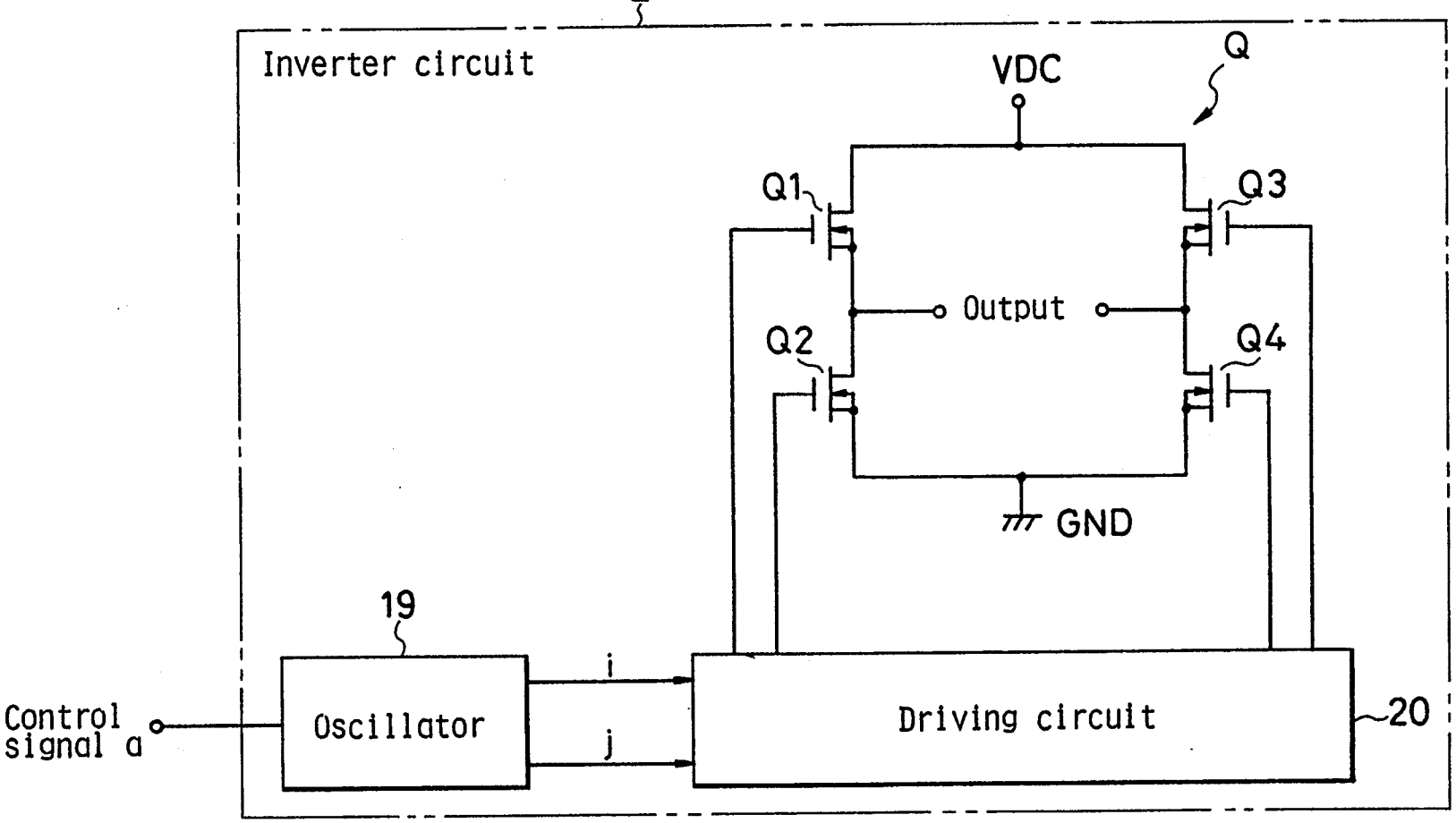
FIG. 3 is a circuit diagram showing a main part of an inverter circuit 2 shown in FIG. 1.

FIG. 3 is a circuit diagram showing a main part of the inverter circuit 2 shown in FIG. 1. In FIG. 3, four transistors Q1, Q2, Q3 and Q4 constitute a bridge inverter Q for supplying the discharge lamp 5 (FIG. 1) with rectangular-wave AC current by way of the starting circuit 4 (FIG. 1). A clock signal oscillator 19 oscillates with a predetermined frequency in response to a signal issued from the lighting control circuit 8 (FIG. 1), thereby supplying a driving circuit 20 with two clock signals i and j which are alternately on. The driving circuit 20 drives the bridge inverter Q in response to output signals of the oscillator 19. Four output signals are input to respective gates of the transistors Q1, Q2, Q3 and Q4 from the driving circuit 20. When the transistors Q1 and Q4, which are diagonally opposite to each other, are turned on at the same time, the transistors Q2 and Q3, which are also diagonally opposite each other, are turned off at the same time. An oscillating frequency of the bridge inverter Q is about 5 kHz when the control signal "a" is issued from the lighting control circuit 8 (FIG. 1) and is about 400 Hz when no control signal is issued from the lighting control circuit 8 (FIG. 1). It is also possible to equip the oscillator 19 with a known time-constant adjusting means in order to gradually vary the oscillating frequency.

Figure 4:
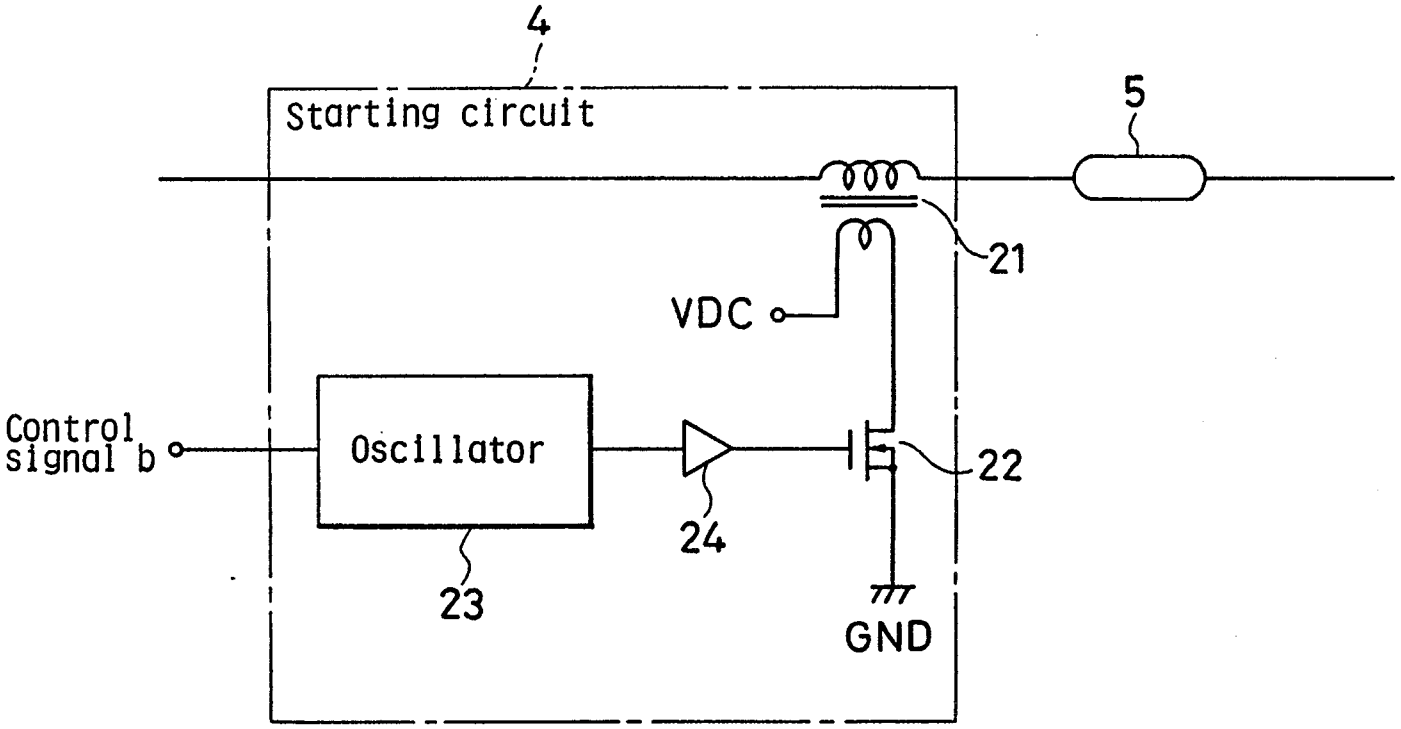
FIG. 4 is a circuit diagram showing a main part of a starting circuit 4 shown in FIG. 1.

FIG. 4 is a circuit diagram showing a main part of the starting circuit 4 shown in FIG. 1. In FIG. 4, the starting circuit 4 is substantially a pulse generator circuit composed of an oscillator 23, a buffer 24, a transistor 22 and a pulse transformer 21. A secondary winding of the pulse transformer 21 Is connected to an output end of the inverter circuit 2 (FIG. 1). The pulse transformer 21 is supplied with the DC output voltage VDC (FIG. 2) of the DC power source 1 (FIG. 1). The transistor 22 is connected in series to a primary winding of the pulse transformer 21. The oscillator 23 starts oscillating upon receipt of the control signal "b" issued from the lighting control circuit 8 (FIG. 1). The buffer circuit 24 gives the transistor 22 switching signals based on output signals of the oscillator 23. The discharge lamp 5 is connected to the secondary winding of the pulse transformer 21. When the control signal "b" is supplied from the lighting control circuit 8 (FIG. 1), a high voltage pulse generates in the secondary winding of the pulse transformer 21, thereby igniting the discharge lamp 5.

Figure 5:
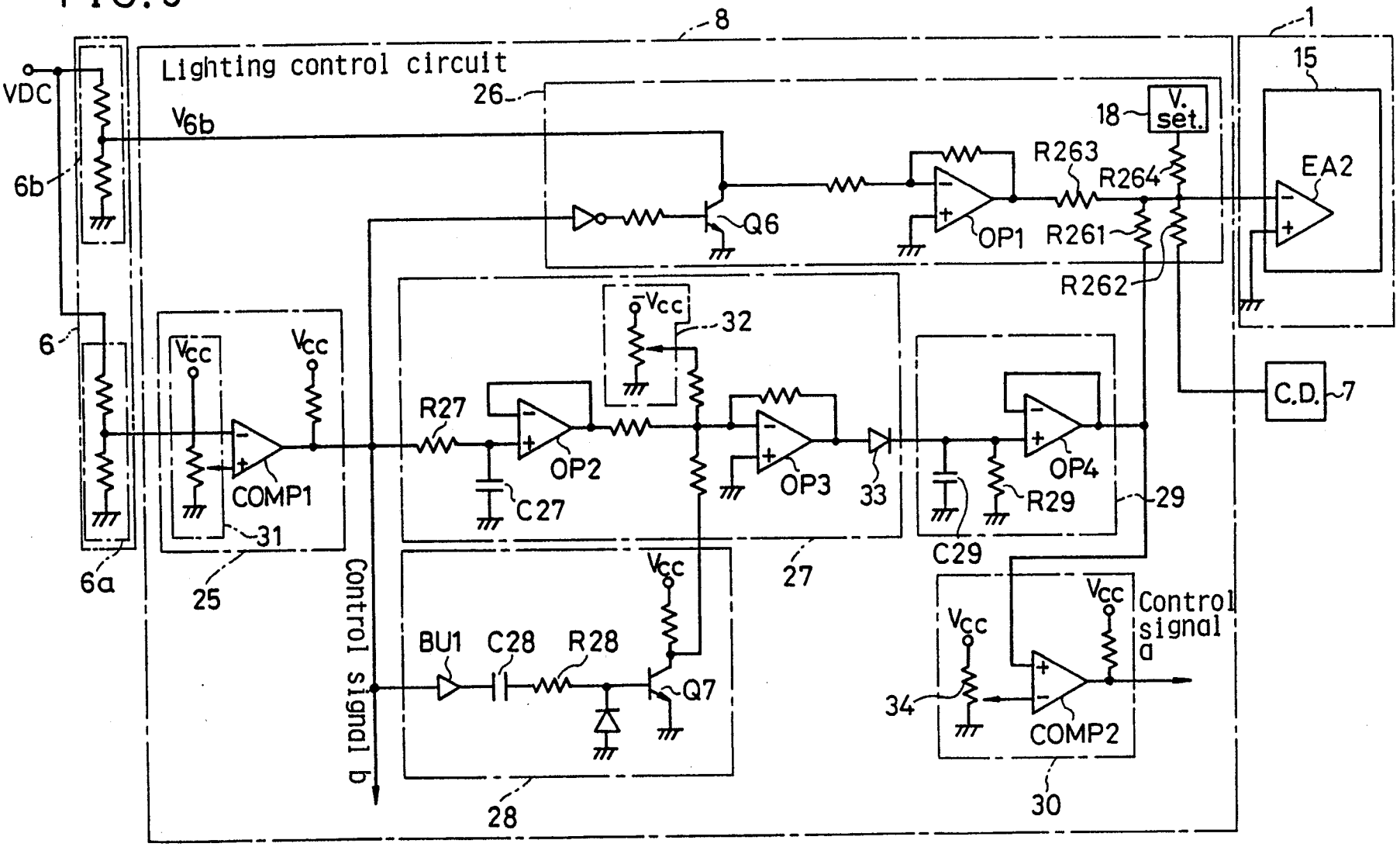
FIG. 5 is a main part of a lighting control circuit 8 shown in FIG. 1.

FIG. 5 shows a main part of the lighting control circuit 8 shown in FIG. 1. In FIG. 5, the lighting control circuit 8 is composed of an on-detection circuit 25, a power control circuit 26, an off-time processing circuit 27, a starting power setting trigger circuit 28, a starting power signal circuit 29 and a starting time monitoring circuit 30. The on-detection circuit 25 receives an output signal of a DC voltage detection circuit **6*a*, which detects the output voltage VDC (FIG. 2) of the DC power source 1 (FIG. 1), and detects whether the discharge lamp 5 (FIG. 1) is lit or not. The power control circuit 26 receives an output voltage of a DC voltage detection circuit 6*b*, to which the output voltage VDC of the DC power source I (FIG. 1) is input, an output of the DC current detection circuit 7 and an output of the starting power signal circuit 29. By inputting a signal to the error amplifier EA2 of the IC 15 in the DC power source 1 (FIG. 1), the power control circuit 26 controls an output power of the DC power source 1 (FIG. 1). The off-time processing circuit 27 receives an output voltage of the on-detection circuit 25 and increases its output signal in response to a length of off-time. The starting power setting trigger circuit 28 receives the output signal of the on-detection circuit 25 and gives a trigger to the off-time processing circuit 27 so that the off-time processing circuit 27 issues an output signal when the discharge lamp 5 (FIG. 1) has just been lit. The starting power signal circuit 29 receives the output signal of the off-time processing circuit 27. Further, the starting power signal circuit 29 sets a power level to the discharge lamp 5 (FIG. 1) for a value which is suitable to the state just after the start and gradually reduces the power level supplied to the power control circuit 26 as time lapses. The starting time monitoring circuit 30 issues the control signal "a" in response to the output signal of the starting power signal circuit 29. When the output signal of the starting power signal circuit 29 has a potential indicating the starting time, the starting time monitoring circuit 30 issues the control signal "a" by which the oscillator 19 (FIG. 3) in the inverter circuit 2 (FIG. 1) oscillates with a high frequency. When the output signal of the starting power signal circuit 29 has no potential indicating the starting time, the starting time monitoring circuit 30 issues the control signal "a" by which the oscillator 19 (FIG. 3) in the inverter circuit 2 (FIG. 1**) oscillates with a low frequency.

A comparator COMP1 of the on-detection circuit 25 compares the output voltage of the DC voltage detection circuit **6*a*, which detects the output voltage VDC of the DC power source 1 (FIG. 1), with an output voltage of the voltage setting circuit 31. When the output voltage of the DC power source 1 is higher than a predetermined voltage, the on-detection circuit 25 issues the control signal "b" of a low level. When the output voltage of the DC power source 1 is lower than the predetermined voltage, the on-detection circuit 25 issues the control signal "b" of a high level. When the control signal "b" of a low level is input to the oscillator 23 (FIG. 4) of the starting circuit 4 (FIGS. 1 and 4), a starting pulse is generated in the starting circuit 4. Further, when the control signal "b" is of a low level, an output terminal of the DC voltage detection circuit 6*b* is grounded (short-circuited) by way of the transistor Q6 in the power control circuit 26. An output voltage of the operational amplifier OP1 is thereby zero-volts, so that it is possible to flow a large current even when the DC voltage is high. Thus, during a time-period when the starting pulse is generated, the error amplifier EA1 (FIG. 2) in the IC 15 (FIG. 2) of the DC power source 1 (FIG. 1**) is operated to render the DC voltage a constant value which is necessary for the start. Therefore, the start of discharging is more surely carried out independent of current or power control operation at the starting time.

When the discharge lamp 5 (FIG. 1) starts discharging, a large DC current flows and thereby the DC voltage lowers. Therefore, the on-detection circuit 25 issues the control signal "b" of a high level. As a result, the starting circuit 4 (FIG. 1) stops operating, and the starting pulse ceases. Further, the transistor Q6 is turned off, thereby activating the output of the DC voltage detection circuit **6*b* at the power control circuit 26. When the control signal "b" is of high level, the transistor Q7 of the power signal setting trigger circuit 28 is turned on only for a time period given by the capacitor C28 and the resistor R28. Therefore, a trigger signal, by which an output voltage of the power signal setting trigger circuit 28 falls down to zero volt, is issued. Although in this embodiment the power signal setting trigger circuit 28 issues the trigger signal which is responsive to the control signal "b" issued from the on-detection circuit 25, another embodiment may be such that the trigger signal is issued by detecting the switching-on of the DC power source 1. Besides, the trigger signal may be issued for a time period after the switching-on of the DC power source 1 (FIG. 1) and before the lighting of the discharge lamp 5 (FIG. 1**).

The off-time processing circuit 27 receives the control signal "b" and integrates it by the resistor R27 and the capacitor C27. An integrated output is issued by way of the buffer amplifier OP2. Further, this output, an output of the starting power signal setting trigger circuit 28 and the output of a bias circuit 32 are added and inversely amplified by the operational amplifier OP3. Since the output of the power signal setting trigger circuit 28 is usually of a high level, an output of the operational amplifier OP3 is negative. Existence of the diode 33 prevents the starting power signal circuit 29 from being influenced by the negative output of the operational amplifier OP3. When the output voltage of the power signal setting trigger circuit 28 becomes zero volts, the operational amplifier OP3 increases the output voltage in response to a decrease of an output voltage of the operational amplifier OP2 by means of the operation of the bias circuit 32 issuing a negative bias voltage and the operational amplifier OP3. In other words, the output voltage of the off-time processing circuit 27 increases in response to a decrease in voltage of the integrating circuit constituted by the resistor R27 and the capacitor C27. That is, the longer the off-time is, the higher the output voltage of the off-time processing circuit 27 becomes.

in the starting power signal circuit 29, the capacitor C29 is charged with electricity by the output voltage of the off-time processing circuit 27, and a voltage generated at the capacitor C29 is issued to the power control circuit 26 by way of the buffer amplifier OP4. The capacitor C29 is charged by the output voltage of the off-time processing circuit 27, which is issued in response to the signal of the power signal setting trigger circuit 28, for an instant after the start of the discharge lamp 5 (FIG. 1). Further, the voltage of the capacitor C29 gradually lowers as time lapses because an electric charge is discharged through the resistor R29. The output voltage of the starting power signal circuit 29 is thus lowered gradually.

The output voltage of the starting power signal circuit 29 is supplied to the inverted terminal of the error amplifier EA2 of the IC 15 by way of a resistor R261 of the power control circuit 26. Furthermore, three outputs other than the output voltage (a first output) of the starting power signal circuit 29 are supplied to the inverted terminal of the error amplifier EA2. That is, an output (a second output) of the DC current detection circuit 7 and an output (a third output) of the voltage setting circuit 18 are supplied to the inverted terminal of the error amplifier EA2 by way of resistors R262 and R264, respectively. Further, a fourth output, which is obtained by inversely amplifying the output of the DC voltage detection circuit *6b* through the operational amplifier OP1, is supplied to the inverted terminal of the error amplifier EA2 by way of a resistor R263. Apart from the circuit shown in FIG. 2 wherein only the output of the voltage setting circuit 18 and the output of the DC current detection circuit 7 are input to the error amplifier EA2 of the control circuit 14 so that the current control can be carried out, in this power control circuit 26 of FIG. 5, two outputs are added further as above-mentioned, thereby enabling the power control. According to this construction, the power can be controlled by changing an on-duty-ratio of the transistor 11 (FIG. 2) in the DC power source 1 with the above-mentioned four outputs so that a current flowing in the inverted terminal of the error amplifier EA2 may be zero.

That is, by inputting the output signal, which is obtained by inversely amplifying the divided output of the DC power source i by the operational amplifier OP1, to the error amplifier EA2 in addition to the outputs of the DC current detection circuit 7 and the voltage setting circuit 18 as shown in FIG. 2, the control is carried out in a manner that a sum of a negative signal based on the DC current and a negative signal based on the DC voltage may offset against a predetermined positive output voltage of the voltage setting circuit 18. As a result, the output power of the DC power source 1 (FIG. 1) can be kept approximately constant within predetermined ranges of current and voltage. Further, the power input to the discharge lamp 5 (FIG. 1) by way of the inverter circuit 2 (FIG. 1) can be kept constant. On the other hand, the output of the starting power signal circuit 29 is also input to the error amplifier EA2, so that a starting power, which is larger than the rated power dependent on the voltage setting circuit 18, can flow in the discharge lamp 5 (FIG. 1) in response to the output of the off-time processing circuit 27. The longer the off-time is and the shorter the on-time is, the larger the starting power becomes. Thus, the large power is supplied to the discharge lamp 5 (FIG. 1) in accordance with length of the off-time and the on-time to properly accelerate increase of light-output; and the lamp-power gradually approaches the rated power with lapse of time after the start, thereby lighting the discharge lamp 5 (FIG. 1) in its rated power so as not to emit the light-output too much.

Although in the above-mentioned embodiment the sum of the signal corresponding to the DC current and the signal corresponding to the DC voltage is controlled to have the predetermined value so that the discharge lamp 5 (FIG. 1) can be lit with the substantially constant power, a modified control system may be such that a product of the signal corresponding to the DC current by the signal corresponding to the DC voltage is controlled to have a predetermined value so that the discharge lamp 5 (FIG. 1) can be lit with the substantially constant power. In such modified control system, the preciseness of power control is further improved.

In the starting time monitoring circuit 30, the output voltage of the starting power signal circuit 29 is compared with the voltage of the voltage setting circuit 34 by the comparator COMP2. When the output voltage of the starting power signal circuit 29 is higher than the voltage of the voltage setting circuit 34, the control signal "a" is issued as a signal indicating that it is the starting time now, thereby making the oscillator 19 (FIG. 3) of the inverter circuit 2 (FIG. 1) oscillate with a high frequency. When the output voltage of the starting power signal circuit 29 is lower than the voltage of the voltage setting circuit 34, the inverter circuit 2 (FIG. 1) regards the starting time as having been completed and thereafter oscillates with a low frequency. According to this control, the frequency of the inverter circuit 2 (FIG. 1) increases during the starting period so that an inductance of the starting circuit 4 (FIG. 1) can have a sufficient voltage. Thus, the DC voltage rises even in a state that the output power Is not very high. Even when the lamp voltage is low during the starting time, a necessary restriking voltage can be secured when the AC voltage is inverted. Lighting is therefore maintained surely during this time. Further, when the starting time has ended, the discharge lamp 5 (FIG. 1) is lit with a low frequency rectangular alternative current, thereby reducing or substantially removing electrophores is and acoustic resonance which are harmful to the discharge lamp 5 (FIG. 1). If a sufficient restriking voltage Is obtained in a low frequency, it is not always necessary to change the frequency during the starting time.

[Second Embodiment]

Figure 6:
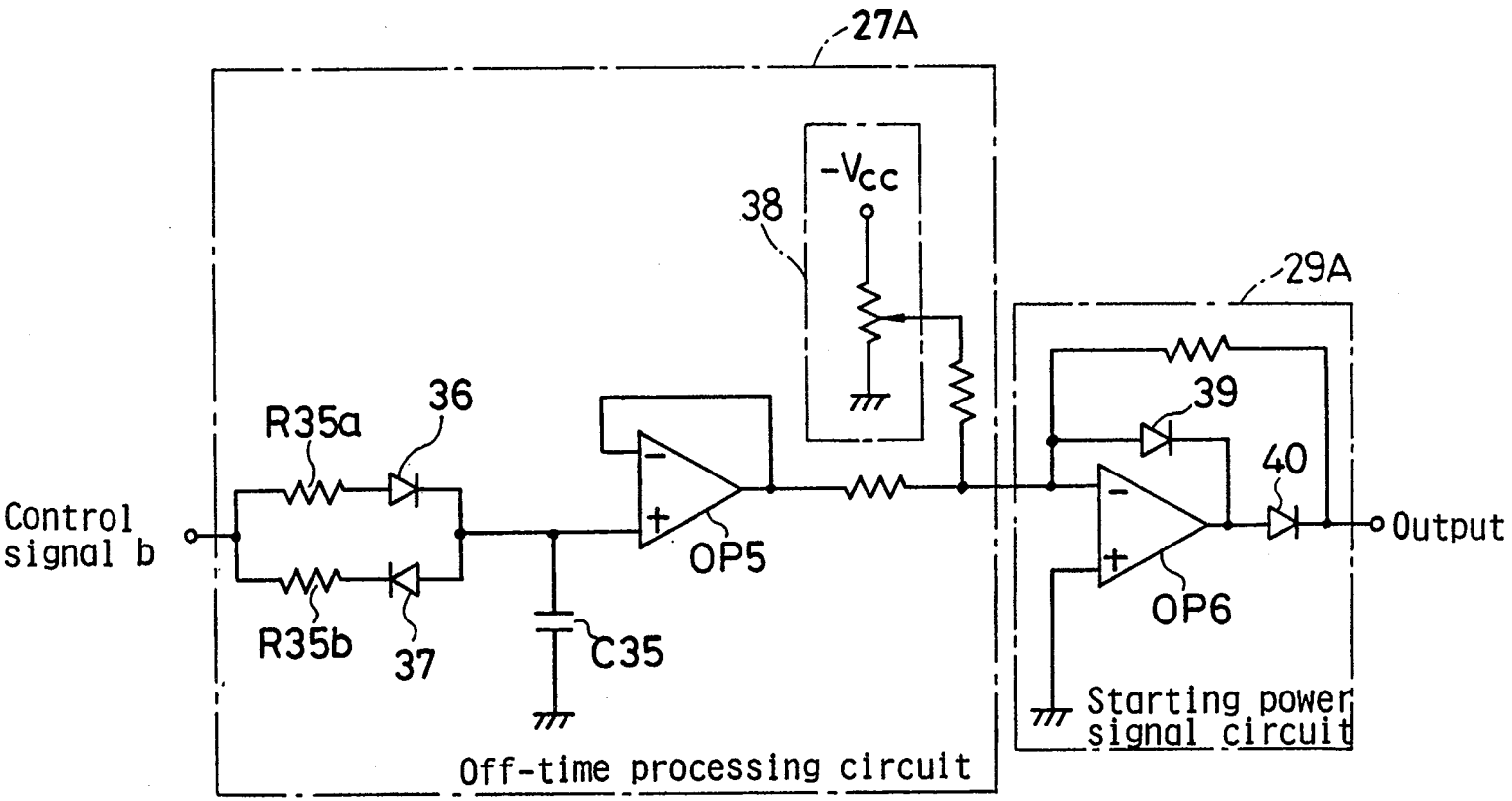
FIG. 6 is a circuit diagram showing a main part of a starting power signal circuit 29A and an off-time processing circuit 27A in accordance with a second embodiment.

FIG. 6 is a circuit diagram showing a main part of a starting power signal circuit 29A and an off-time processing circuit 27A by which the starting power signal circuit 29 (FIG. 5) and the off-time processing circuit 27 (FIG. 5) may be replaced, respectively, as a second embodiment. Main differences of this second embodiment from the first embodiment (FIG. 5) are as follows:

A time constant circuit, which is responsive to the off-time and the on-time, and a time constant circuit, which lowers the control signal so as to gradually reduce the starting power for the discharge lamp, are incorporated with each other; and a power signal setting trigger circuit 28 as shown in FIG. 5 is omitted.

In FIG. 6, when the discharge lamp 5 (FIG. 1) is being lit and an output of the starting power signal circuit 29A is of high level, a capacitor C35 is charged with electricity given by the control signal "b" by way of a resistor R35*a* and a diode 36. When the discharge lamp 5 is off and the output of the starting power signal circuit 29A is of a low level, electric charge stored in the capacitor C35 is discharged by way of a resistor R35*b* and a diode 37. A buffer amplifier OP5, a bias circuit 38 and an operational amplifier OP6 are provided in the similar way to the buffer amplifier OP2, the bias circuit 32 and the operational amplifier OP4 as shown in FIG. 5. Integration output of the capacitor C35 is issued by way of the buffer amplifier OP5 and is input to the inverted terminal of an operational amplifier OP6 together with an output of the bias circuit 38. The operational amplifier OP6 inverts and amplifies these inputs. Owing to the operation of the operational amplifier OP6 and the bias circuit 38 supplying the negative bias voltage, the operational amplifier OP6 increases the output voltage in response to a decrease of the output voltage of the operational amplifier OP5. That is, the longer the off-time is or the shorter the on-time before the last turning-off is, the lower the voltage of the capacitance C35 becomes, thereby increasing the output voltage of the starting power signal circuit 29A. Therefore, it is possible to have a large starting power just after the start. When the discharge lamp 5 (FIG. 1) has started discharging, the output of the on detection circuit 31 is of a high level. Since the voltage of the capacitor C35 increases with a lapse of time, the output of the starting power signal circuit 29A lowers to zero volts. As a result, the starting power lowers and soon the discharge lamp 5 (FIG. 1) is lit with the rated power consumption. Since diodes 39 and 40 are used in place of the diode 33 (FIG. 5), an inverted amplification of an absolute value is carried out in the operational amplifier OP6 independent of the forward directional voltage of the diodes. Thus, according to the starting power signal circuit 29A shown in FIG. 6, the power control based on the off-time and the on-time is carried out by a simple circuit. In this embodiment, time constants based on the off-time and the on-time are changeable independently by means of the respective resistors R35*a* and R35*b*. However, if the time constants may be equal to each other, the diode 36 and 37 are unnecessary; and only one resistor may be used in place of the resistors R35*a* and R35*b*. Alternatively, the resistor R35*b*, which is for discharging the electric charge, may be connected in parallel with the capacitor C35.

Hereupon, in this embodiment, it is necessary select the time constants which rapidly increase the light-output and save the power after the start so as not to emit the light-output too much.

[Third Embodiment]

Next, a third embodiment of the present invention is described.

Figure 7:
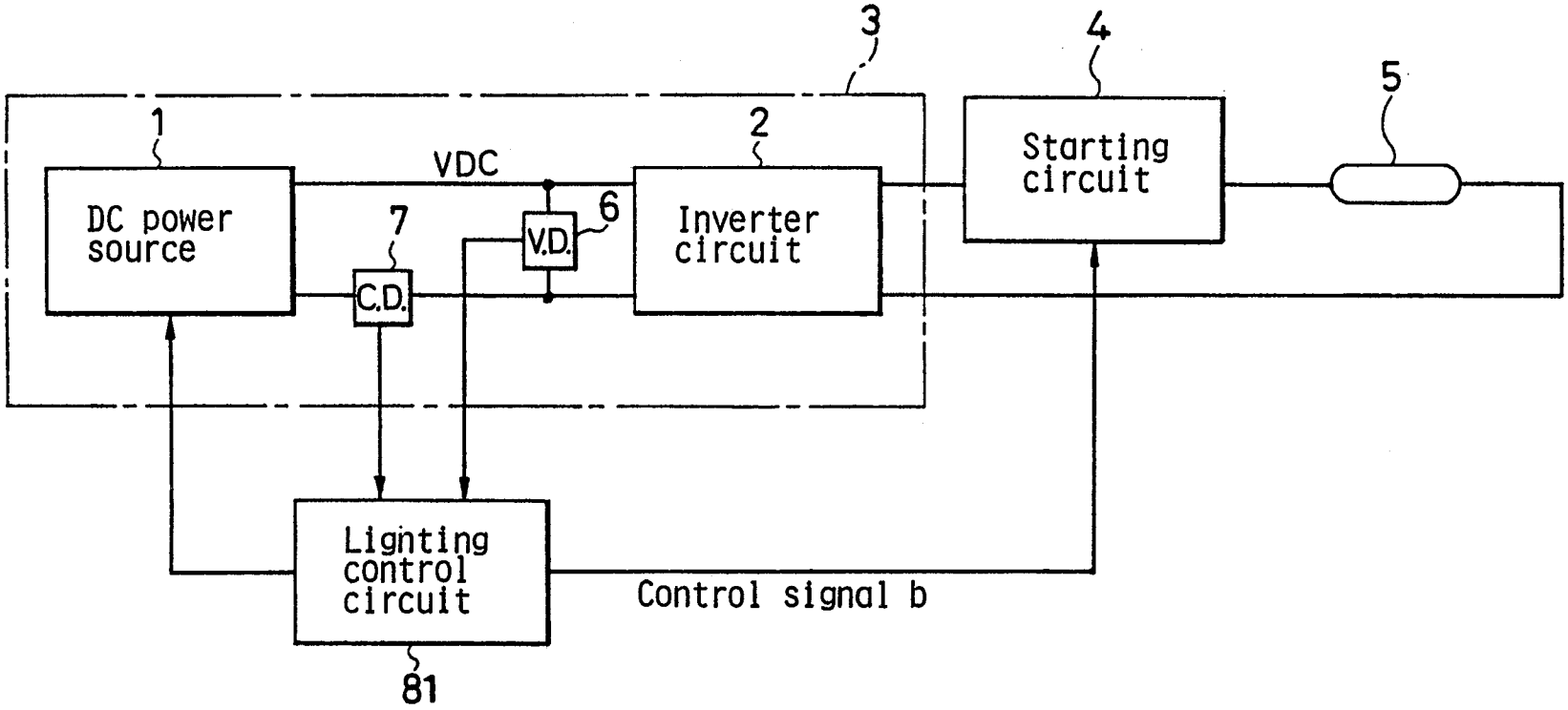
FIG. 7 is a block diagram showing a basic construction of a discharge-lamp lighting apparatus of a third embodiment.

FIG. 7 is a block diagram showing a basic construction of the discharge-lamp lighting apparatus of the third embodiment. Corresponding parts to FIG. 1 of the first embodiment are shown by the same numerals, and the description thereon made in the first embodiment similarly applies. A first difference of this figure from FIG. 1 is that a control signal line which carries the control signal "a" as shown in FIG. 1 is not provided, and a second difference is that a lighting control circuit 81 has a different function from the lighting control circuit 8 shown in FIG. 1.

Next, the basic operation of the above-mentioned third embodiment Is described. When the DC power source 1 is turned on, the inverter circuit 2 begins to oscillate with a low frequency (e.g., 400 Hz) having no fear to cause acoustic resonance, and the DC voltage detection circuit 6 detects an output voltage of the DC power source 1. When this output voltage reaches a predetermined voltage required for start, the lighting control circuit 81 turns the starting circuit 4 on in response to an output of the DC voltage detection circuit 6, thereby applying a starting voltage to the discharge lamp 5. The discharge lamp 5 thereby starts discharging. As a result of current-flowing through the discharge lamp 5, a voltage applied between both ends of the discharge lamp 5 lowers, and the output voltage of the DC power source 1 also lowers. By detecting this voltage drop by way of the DC voltage detection circuit 6, the lighting control circuit 81 knows that the discharge lamp 5 has just started, and turns the starting circuit 4 off. Once the discharge lamp 5 starts discharging, the lighting control circuit 81 controls the output of the DC power source 1 in response to an off-time before the start and an on-time after the start. That is, the longer off-time is, the larger the output just after the start becomes. Once started, the output is gradually reduced as the on-time lapses until the discharge lamp 5 is lit with the rated power.

Since details of the DC power source 1 and the starting circuit 4 are quite equal to those shown in FIGS. 2 and 4 of the first embodiment, respectively, the description thereon made in the first embodiment similarly applies.

Figure 8:
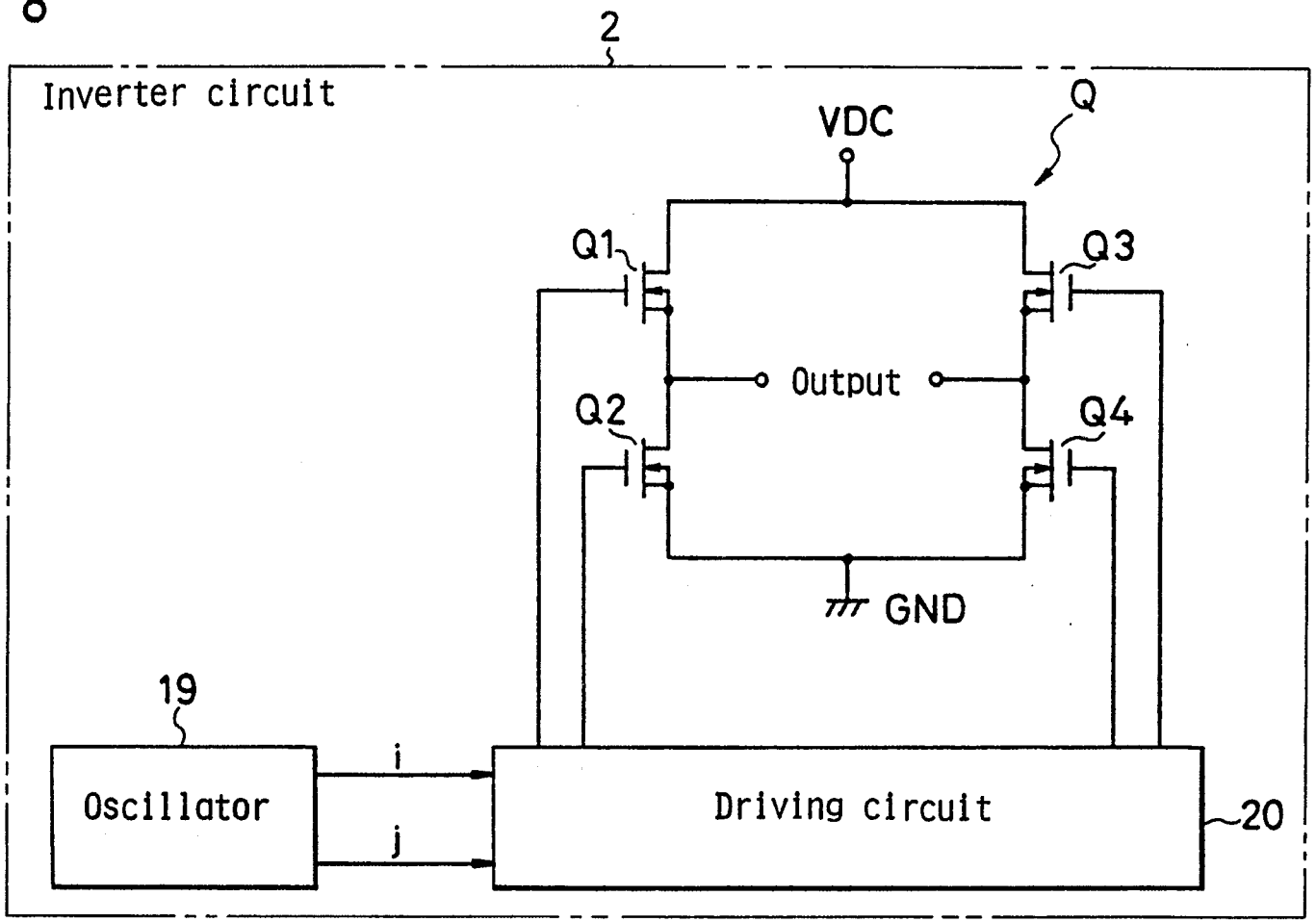
FIG. 8 Is a circuit diagram showing a main part of an inverter circuit 2 shown in FIG. 7.

FIG. 8 is a circuit diagram showing a main part of the inverter circuit 2 shown in FIG. 7. In FIG. 8, four transistors Q1, Q2, Q3 and Q4 constitute a bridge inverter Q for supplying the discharge lamp 5 (FIG. 7) with rectangular-wave AC current by way of the starting circuit 4 (FIG. 7). An oscillator 19 oscillates with a frequency of 400 Hz, thereby supplying a driving circuit 20 with two clock signals which are alternately on. The driving circuit 20 drives the bridge inverter Q in response to the output signals of the oscillator 19. Four output signals are input to respective gates of the transistors Q1, Q2, Q3 and Q4 from the driving circuit 20. When the transistors Q1 and Q4, which are diagonally opposite to each other, are turned on at the same time, the transistors Q2 and Q3, which are also diagonally opposite to each other, are turned off at the same time.

Figure 9:
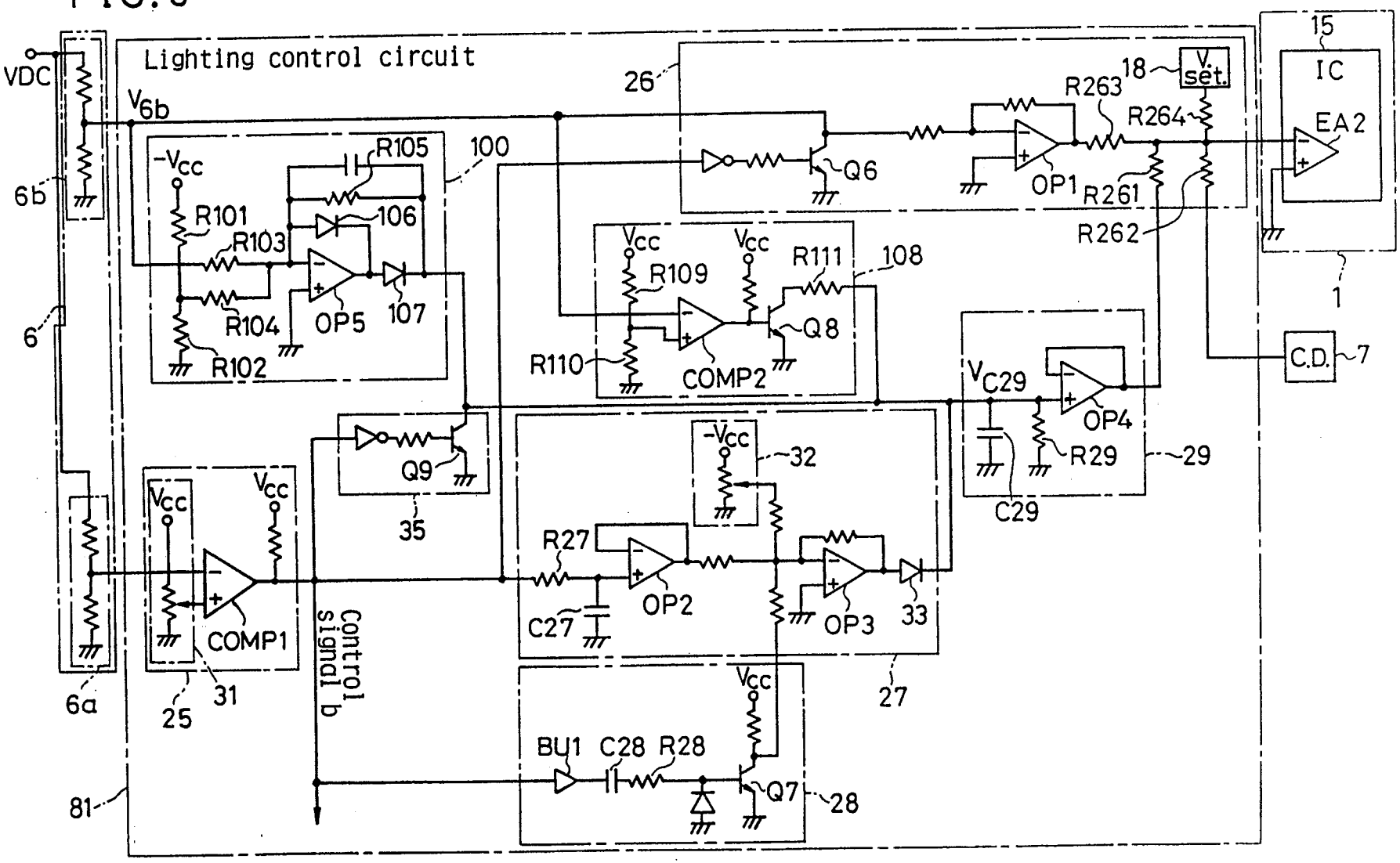
FIG. 9 is a main part of a lighting control circuit 81 shown in FIG. 7.

FIG. 9 is a main part of the lighting control circuit 81 shown in FIG. 7. In FIG. 9, the lighting control circuit 8 is composed of an on-detection circuit 25, a power control circuit 26, an off-time processing circuit 27, a starting power setting trigger circuit 28, a starting power signal circuit 29, a reset circuit 35, a starting power arithmetic circuit 100 and a time-constant changeover circuit 108. The on-detection circuit 25 receives an output signal of a DC voltage detection circuit 6a, which detects the output voltage VDC (FIG. 2) of the DC power source 1 (FIG. 7), and detects whether the discharge lamp 5 (FIG. 7) is lit or not. The power control circuit 26 receives a voltage based on the output voltage VDC of the DC power source 1 (FIG. 7), an output of the DC current detection circuit 7 and an output of the starting power signal circuit 29. By inputting a signal to the error amplifier EA2 of the IC 15 in the DC power source 1 (FIG. 7), the power control circuit 26 controls an output power of the DC power source 1 (FIG. 7). The off-time processing circuit 27 receives an output voltage of the on-detection circuit 25 and increases its output signal in response to a length of the off-time. The starting power setting trigger circuit 28 receives the output signal of the on-detection circuit 25 and gives a trigger to the off-time processing circuit 27 so that the off-time processing circuit 27 issues an output signal when the discharge lamp 5 (FIG. 7) has just been lit. The starting power signal circuit 29 receives the output signal of the off-time processing circuit 27. Further, the starting power signal circuit 29 sets a power level to the discharge lamp 5 (FIG. 7) for a value which is suitable to the state just after the start and gradually reduces the power level supplied to the power control circuit 26 as time lapses. The reset circuit 35 resets an input voltage of the starting power signal circuit 29 at the start of the discharge lamp 5 (FIG. 7). The starting power arithmetic circuit 100 generates a starting power signal in response to the output voltage of the DC power source 1 (FIG. 7) which corresponds to the lamp voltage. The time-constant change over circuit 108 changes the time-constant for reducing the starting power at a predetermined lamp voltage. The off-time processing circuit 27 and the starting power signal setting trigger circuit 28 constitute initial starting power setting means.

A comparator COMP1 of the on-detection circuit 25 compares the output voltage of the DC voltage detection circuit 6a, which detects the output voltage VDC of the DC power source 1 (FIG. 7), with an output voltage of the voltage setting circuit 31. When the output voltage of the DC power source 1 is higher than a predetermined voltage, the on-detection circuit 25 issues the control signal "b" of a low level. When the output voltage of the DC power source 1 is lower than the predetermined voltage, the on-detection circuit 25 issues the control signal "b" of a high level. When the control signal "b" of a low level is input to the oscillator 23 (FIG. 4) of the starting circuit 4 (FIGS. 1 and 4), a starting pulse is generated in the starting circuit 4. Further, when the control signal "b" is of a low level, an output terminal of the DC voltage detection circuit 6b is grounded (short-circuited) by way of the transistor Q6 in the power control circuit 26. An output voltage of the operational amplifier OP1 is thereby zero-volts, so that it is possible to flow a large current even when a DC voltage is a high. Thus, during a time-period when the starting pulse is generated, the error amplifier EA1 (FIG. 2) in the IC 15 (FIG. 2) of the DC power source 1 (FIG. 7) is operated to render the DC voltage a constant value which is necessary for the start. Since the control signal "b" is of a low level, a transistor Q9 of the reset circuit 35 turns on, thereby making the capacitor C29 of the starting power signal circuit 29 discharge through the transistor Q9. A voltage $V_{C29}$ is thereby "reset".

When the discharge lamp 5 (FIG. 7) starts discharging, a large DC current flows and thereby the DC voltage lowers. Therefore, the on-detection circuit 25 issues the control signal "b" of a high level. As a result, the starting circuit 4 (FIG. 7) stops operating, and the starting pulse ceases. Further, the transistor Q6 is turned off, thereby activating the output of the DC voltage detection circuit 6b at the power control circuit 26. An output voltage $V_{6b}$ of the DC voltage detection circuit 6b is input to the starting power arithmetic circuit 100. When this voltage $V_{6b}$ is less than a predetermined lamp voltage, the starting power arithmetic circuit 100 lowers its output signal in response to a increase of the lamp voltage. That is, the output signal of the starting power arithmetic circuit 100 is in inverse relation to the lamp voltage. When the voltage $V_{6b}$ is equal to or more than the predetermined lamp voltage, the output voltage of the starting power arithmetic circuit 100 is rendered zero.

Figure 10:
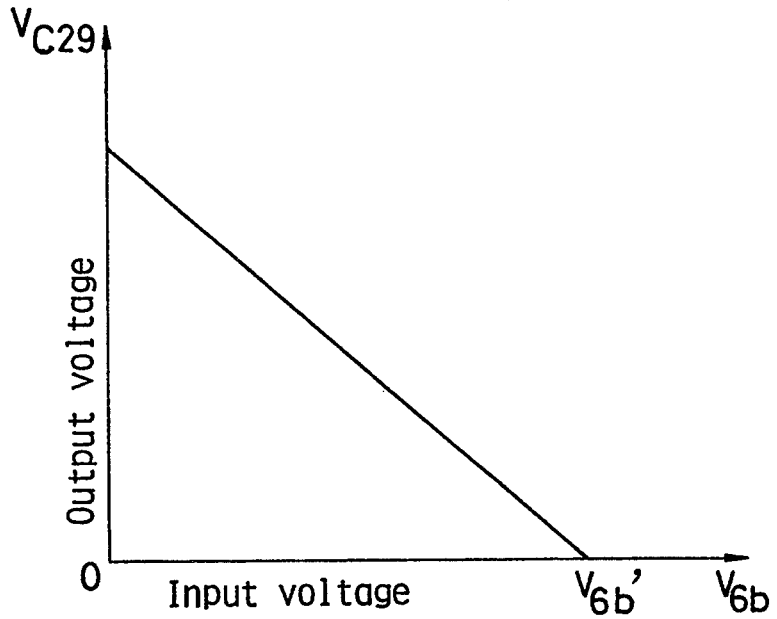
FIG. 10 is a graph showing a relationship between an input voltage $V_{6b}$ and an output voltage $V_{C29}$ from a starting power arithmetic circuit 100 shown in FIG. 9.

FIG. 10 is a graph showing a relationship between the input voltage $V_{6b}$ and an output voltage $V_{C29}$ of the starting power arithmetic circuit 100.

In FIG. 9, a bias voltage is supplied to the operational amplifier OP5 by means of resistors R101 and R102. The operational amplifier OP5 inversely amplifies this bias voltage. As shown in FIG. 10, when the input voltage is equal to or more than the voltage $V_{6b'}$, the output voltage of the starting power arithmetic circuit 100 is zero volts by means of diodes 106 and 107. Therefore, the higher the lamp voltage is, the lower the starting power becomes.

When the control signal "b" is of a high level, the transistor Q7 of the power signal setting trigger circuit 28 is turned on only for a time period given by the capacitor C28 and the resistor R28. Therefore, a trigger signal, by which an output voltage of the power signal setting trigger circuit 28 falls down to zero volts, is issued. Although in tills embodiment the power signal setting trigger circuit 28 issues the trigger signal which is responsive to the control signal "b" issued from the on-detection circuit 25, another embodiment may be such that the trigger signal is issued by detecting switching-on of the DC power source 1. Besides, the trigger signal may be issued for a time period after the switching-on of the DC power source 1 (FIG. 7) and before the lighting of the discharge lamp 5 (FIG. 7).

The off-time processing circuit 27 receives the control signal "b" and integrates It by the resistor R27 and the capacitor C27. An integrated output is issued by way of the buffer amplifier OP2. Further, this output, an output of the starting power signal setting trigger circuit 28 and an output of a bias circuit 32 are added to each other and inversely amplified by the operational amplifier OP3. Since the output of the power signal setting trigger circuit 28 is usually of a high level, an output of the operational amplifier OP3 is negative. Existence of the diode 33 prevents the starting power signal circuit 29 from being influenced by the negative output of the operational amplifier OP3. When the output voltage of the power signal setting trigger circuit 28 becomes zero volts, the operational amplifier OP3 increases the output voltage in response to a decrease of the output voltage of the operational amplifier OP2 by means of operations of the bias circuit 32 which issues a negative bias voltage and the operational amplifier OP3. In other words, the output voltage of the off-time processing circuit 27 increases in response to a decrease in the voltage of the integrating circuit constituted by the resistor R27 and the capacitor C27. That is, the longer the off-time is, the higher the output voltage of the off-time processing circuit 27 becomes.

In the starting power signal circuit 29, the capacitor C29 is charged with electricity by the output voltage of the off-time processing circuit 27 or the output voltage of the starting power arithmetic circuit 100. A voltage charged in the capacitor C29 is the higher one of these output voltages. The voltage generated at the capacitor C29 is issued to the power control circuit 26 by way of the buffer amplifier OP4. Since the lamp voltage is a low at the time just after the start after a long time off, the output voltage of the starting power arithmetic circuit 100 is then made high, thereby increasing the voltage of the capacitor C29. At that time, since the last off-time is long, the output voltage of the off-time processing circuit 27 is also high. However, the output voltage of the starting power arithmetic circuit 100 is set higher than the output voltage of the off-time processing circuit 27 in case the off-time exceeds a predetermined length. Since the lamp voltage is still high in case the last off-time is short, the output voltage of the starting power arithmetic circuit 100 is set low, and to zero volts in case the lamp voltage exceeds a predetermined level. Even in such case as mentioned above, the output voltage of the off-time processing circuit 27 is equal to or more than the predetermined level. This output voltage rises in response to an increase of the off-time.

According to this control system, when the output voltage of the starting power arithmetic circuit 100 is a low as a result of a short off-time, power control is carried out in response to the output of the off-time processing circuit 27 by way of the starting power signal circuit 29 and the power control circuit 26. Thus, the starting power adapted to the last off-time is supplied to the discharge lamp 5 (FIG. 7). When the output voltage the starting power arithmetic circuit 100 is higher than the output voltage of the off-time processing circuit 27 as a result of a long off-time, power control is carried out in response to the output of the starting power arithmetic circuit 100 by way of the starting power signal circuit 29 and the power control circuit 26. Thus, the starting power adapted to the lamp voltage is supplied to the discharge lamp 5 (FIG. 7).

In the off-time of the discharge lamp 5 (FIG. 7), sealed metals are attached to an inner wall of a lamp bulb. Therefore, It was generally impossible for the discharge lamp 5 to emit a rated light-output just after the restart. However, in this embodiment an initial lamp power is set larger than the lamp power of the steady lighting state just after the start or the restart. By supplying the discharge lamp 5 with this large lamp power, a sufficient light-output that is close to the rated light-output is obtained just after the restart.

Further, the initial lamp power is set larger than at least the lamp power of the steady lighting state just after the start or the restart in response to the output of the off-time processing circuit 27; and the initial lamp power an increases in response to increase of the off-time. Therefore, when the off-time is short, an initial lamp power, which is not very large, is supplied to the discharge lamp 5 at restart. This is based on because luminous efficiency hardly lowers because of a still a high vapor pressure of the sealed metals and because very little of the sealed metals are attached on the inner wall of the discharge lamp 5. When the off-time increases, a large initial lamp power is supplied to the discharge lamp 5 on the restart, thereby making the discharge lamp 5 emit the light-output nearly equal to that of the steady lighting state just after the restart. This is based on a fact that the light-output increases slowly because of declination of the vapor pressure and attachment of much of the sealed metals on the inner wall.

Figure 11:
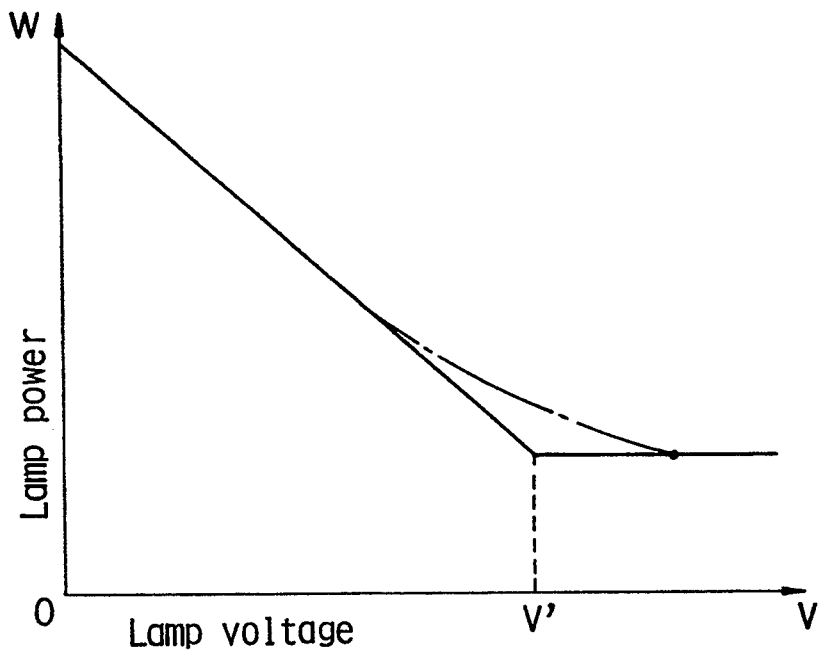
FIG. 11 is a graph showing a relation between the lamp voltage (V) and the lamp power (W).

FIG. 11 is a graph showing a relationship between the lamp voltage (V) and the lamp power (W). Power control is carried out to trace the solid lines in the figure. That is, a large lamp power is supplied to the discharge lamp 5 (FIG. 7) in a starting voltage range of from zero to a predetermined lamp voltage V', and a constant lamp power is supplied to the discharge lamp 5 (FIG. 7) in a steady lighting range of more than the lamp voltage V'. Thus, a large lamp power is input to the discharge lamp 5 (FIG. 7) for the start, so that the discharge lamp 5 quickly attains the steady lighting state. Further, since the constant power is supplied to the discharge lamp 5 in the steady lighting state, the discharge lamp 5 is lit with a rated power consumption.

In FIG. 9, the capacitor C29 is charged with electricity by the output voltage of the starting power arithmetic circuit 100 or the off-time processing circuit 27 for an instant just after the start. Thereafter, electric charge stored in the capacitor C29 is gradually discharged through the resistor R29 as time lapses. The output of the starting power signal circuit 29 is thereby lowered gradually. Besides, a time constant of the starting power signal circuit 29 is changed by the time constant change-over circuit 108 so that the time constant for lowering the lamp power can be increased when the lamp voltage reaches the predetermined voltage. That is, when the lamp voltage is higher than the predetermined voltage, a comparator COMP2 compares the output of the DC voltage detection circuit **6*b* with a divided voltage by resistors R109 and R110. As a result, a transistor Q8 is turned off by receiving a negative output of the comparator COMP2, thereby releasing a resistor 111. A discharging time constant is thus increased. By making the time constant large when the lamp voltage reaches or exceeds the predetermined voltage, a lowering of the lamp power is decelerated as shown by a chain curve in FIG. 11. Therefore, after the light-output actually reaches the rated power, the discharge lamp 5 (FIG. 7**) shifts to the steady lighting state without any sudden change of power.

The output voltage of the starting power signal circuit 29 is supplied to the inverted terminal of the error amplifier EA2 of the IC 15 by way of a resistor R261 of the power control circuit 26. Furthermore, three outputs other than the output voltage (a first output) of the starting power signal circuit 29 are supplied to the inverted terminal of the error amplifier EA2. That is, an output (a second output) of the DC current detection circuit 7 and an output (a third output) of the voltage setting circuit 18 are supplied to the inverted terminal of the error amplifier EA2 by way of resistors R262 and R264, respectively. Further, a fourth output, which is obtained by inversely amplifying the output of the DC voltage detection circuit **6*b* through the operational amplifier OP1, is supplied to the inverted terminal of the error amplifier EA2 by way of a resistor R263. Apart from the circuit shown in FIG. 2 wherein only the output of the voltage setting circuit 18 and the output of the DC current detection circuit 7 are input to the error amplifier EA2 of the control circuit 14 so that the current control can be carried out, in this power control circuit 26 two outputs are added further as above-mentioned, thereby enabling the power control. According to this construction, the power can be controlled by changing an on-duty-ratio of the transistor 11 (FIG. 2) in the DC power source 1** with the above-mentioned four outputs so that a current flowing in the inverted terminal of the error amplifier EA2 may be zero.

That is, by inputting the output, which is obtained by inversely amplifying the divided output of the DC power source 1 through the operational amplifier OP1, in addition to the outputs of the DC current detection circuit 7 and the voltage setting circuit 18 as shown in FIG. 2, control is carried out in a manner that a sum of a negative signal based on the DC current and a negative signal based on the DC voltage offsets against a predetermined positive output voltage of the voltage setting circuit 18. As a result, the output power of the DC power source 1 (FIG. 7) can be kept approximately constant within predetermined ranges of current and voltage. Further, the power input to the discharge lamp 5 (FIG. 1) by way of the inverter circuit 2 (FIG. 7) can be kept constant.

On the other hand, the output of the starting power arithmetic circuit 100 responding to the output of the DC voltage detection circuit **6*b*, which corresponds to the lamp voltage, is input to the starting power signal circuit 29 together with the output (corresponding to the off-time and the on-time) of the off-time processing circuit 27. Further, the output of the starting power signal circuit 29 is also input to the error amplifier EA2, so that a starting power, which is larger than the rated power dependent on the voltage setting circuit 18, can flow in the discharge lamp 5 (FIG. 7) in response to the larger one of the output of the off-time processing circuit 27 and the output of the starting power arithmetic circuit 100. The longer the off-time is and the shorter the on-time is, the larger the starting power is. Furthermore, the lower the lamp voltage is, the larger the starting power becomes. Thus, the large power is supplied to the discharge lamp 5 (FIG. 7) in accordance with the lamp voltage or length of the off-time and the on-time to properly accelerate an increase of the light-output; and the lamp-power gradually approaches the rated power with lapse of time after the start, thereby lighting the discharge lamp 5 (FIG. 7**) in its rated power so as not to emit the light-output too much.

Although in the above-mentioned third embodiment the sum of the signal corresponding to the DC current and the signal corresponding to the DC voltage is controlled to have the predetermined value so that the discharge lamp 5 (FIG. 7) can be lit with substantially constant power, a modified control system may be such that a product of the signal corresponding to the DC current by the signal corresponding to the DC voltage is controlled to have a predetermined value so that the discharge lamp 5 (FIG. 7) can be lit with substantially constant power. In this modified control system, the preciseness of power control is further improved.

Hereupon, in this third embodiment, concerning the control characteristics of the starting power arithmetic circuit 100 and the time constants of the off-time processing circuit 27, the starting power signal circuit 29 and the time-constant changeover circuit 108, it is necessary to select them to have an appropriate condition or value which rapidly increases the light-output and saves power after the start so as not to emit the light-output too much.

Apart from the above-mentioned embodiments wherein the flyback type DC/DC converter is used as a DC power source, a modified embodiment may be such that a forward type DC/DC converter or a push-pull type DC/DC converter is used as the DC power source. Concerning the inverter circuit, other inverters such as half-bridge type or push-pull type can be used.

Further, apart from the above-mentioned embodiments wherein the DC power source 1 (FIG. 1 or FIG. 7) is controlled, another embodiment may be such that the inverter circuit 2 (FIG. 1 or FIG. 7) is controlled. However, it is advantageous in terms of convenience in detection and control to control the output of the DC power source 1. Furthermore, unlike these control methods, the output of lamp current supply means may be controlled.

in the above-mentioned embodiments, an output power level or an output current level of the lamp current supply means 3 (FIG. 1 or 7) is set by the lighting control circuit 8 or 81 in a time period from the power on to just after the start; and after the start the output current level or the output power level is decreased as time lapses to a rated lighting state. This control is not applied directly to an AC circuit consisting of the discharge lamp 5 and the starting circuit 4 (FIG. 1 or 7) but applied to the DC power source 1 (FIG. 1 or 7). Therefore, electric noise originating in the AC circuit is not transmitted to the lighting control circuit 8 or 81. Operation of the lighting control circuit 8 or 81 is therefore carried out surely.

Although in the above-mentioned embodiments only the low frequency and rectangular wave lighting apparatus are used, the high frequency lighting apparatus or the DC lighting apparatus may be used, provided that the discharge lamp generates no harmful phenomenon such as electrophoresis or acoustic resonance.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A discharge-lamp lighting apparatus comprising;

a discharge lamp;

lamp current supply means for supplying said discharge lamp with a current; and lighting control means for controlling an output of said lamp current supply means in response to an off-time and an on-time of said discharge lamp, said lighting control means increasing its initial output in response to increase of said off-time and decreasing its output to a rated output as time lapses after start-up of said discharge lamp;

said lighting control means determines an output level of said lamp current supply means, which is in a state just after start-up of said discharge lamp, within a time period from power-on of said lamp current supply means to start-up of said discharge lamp; and said lighting control means decreases said output level to a rated level as time lapses after said start-up.

2. A discharge-lamp lighting apparatus comprising:

a discharge lamp;

lamp current supply means for supplying said discharge lamp with a current;

lamp voltage detection means for detecting a lamp voltage applied to said discharge lamp;

lamp current detection means for detecting a lamp current flowing in said discharge lamp;

power control means which receives outputs of said lamp voltage detection means and said lamp current detection means to control a lamp power of said discharge lamp; and a lighting control circuit which receives an output of said lamp voltage detection means within a starting-time of said discharge lamp and issues an output signal for controlling said lamp power to said power control means, said lighting control circuit changing a level of said output signal in inverse relation to said lamp voltage and issuing a constant output signal for lighting said discharge lamp with a rated power after said starting time;

said lighting control circuit comprises:

i.) lamp power arithmetic means, which decrease its output signal in a lamp voltage range less than a predetermined voltage in response to increase of said lamp voltage and renders said output signal zero in a lamp voltage range equal to or more than said predetermined voltage; and ii.) bias means for biasing said lighting control circuit with a predetermined voltage output; and an output of said lamp current supply means is controlled by an output based on a sum of outputs of said lamp power arithmetic means and said bias means.

3. A discharge-lamp lighting apparatus in accordance with claims 2, wherein said lighting control circuit comprises a time-constant changeover circuit which is connected to said lamp power arithmetic means to be operated by a predetermined lamp voltage; and said time-constant changeover circuit increases a time constant of lowering a lamp power in said lamp power arithmetic means.

4. A discharge-lamp lighting apparatus comprising:

a discharge lamp;

lamp current supply means for supplying said discharge lamp with a current;

lamp voltage detecting means for detecting a lamp voltage applied to said discharge lamp;

lamp current detection means for detecting a lamp current flowing in said discharge lamp;

power control means which receives outputs of said lamp voltage detection means and said lamp current detection means to control a lamp power of said discharge lamp; and a lighting control circuit which receives an output of said lamp voltage detection means within a starting-time of said discharge lamp and issues an output signal for controlling said lamp power to said power control means, said lighting control circuit changing a level of said output signal in inverse relation to said lamp voltage and issuing a constant output signal for lighting said discharge lamp with a rated power after said starting time;

said lighting control circuit comprises starting power setting means for setting a predetermined initial lamp power, which is larger than a lamp power of a steady lighting state, just after start of discharging; and said lighting control circuit issues an output signal based on a larger one of said initial lamp power and a power determined by said lamp voltage and after start-up issues an output signal for lighting said discharge lamp with a rated power after said starting time.

5. A discharge-lamp lighting apparatus in accordance with claim 4, wherein said starting power setting means comprises an off-time processing circuit for detecting a length of an off-time of said discharge lamp and a starting power setting trigger circuit for making said off-time processing circuit issue an output signal by which said initial lamp power is determined in response to a length of said off-time; and said initial lamp power is based on a length of said off-time.

* * * * *